US010590899B2

(12) United States Patent
Schnobrich et al.

(10) Patent No.: US 10,590,899 B2
(45) Date of Patent: Mar. 17, 2020

(54) FUEL INJECTORS WITH IMPROVED COEFFICIENT OF FUEL DISCHARGE

(71) Applicant: 3M INNOVATIVE PROPERTIES COMPANY, St. Paul, MN (US)

(72) Inventors: Scott M. Schnobrich, Cottage Grove, MN (US); Barry S. Carpenter, Oakdale, MN (US); Barbara A. Fipp, Minneapolis, MN (US); James C. Novack, Hudson, WI (US); David H. Redinger, Afton, MN (US); Ryan C. Shirk, Mendota Heights, MN (US)

(73) Assignee: 3M INNOVATIVE PROPERTIES COMPANY, St. Paul, MN (US)

( * ) Notice: Subject to any disclaimer, the term of this patent is extended or adjusted under 35 U.S.C. 154(b) by 911 days.

(21) Appl. No.: 14/417,825

(22) PCT Filed: Aug. 1, 2013

(86) PCT No.: PCT/US2013/053153

§ 371 (c)(1),
(2) Date: Jan. 28, 2015

(87) PCT Pub. No.: WO2014/022631

PCT Pub. Date: Feb. 6, 2014

(65) Prior Publication Data

US 2015/0204291 A1 Jul. 23, 2015

Related U.S. Application Data

(60) Provisional application No. 61/678,305, filed on Aug. 1, 2012.

(51) Int. Cl.
*F02M 61/18* (2006.01)
*F02M 61/16* (2006.01)

(52) U.S. Cl.
CPC ..... *F02M 61/1806* (2013.01); *F02M 61/168* (2013.01); *F02M 61/184* (2013.01);
(Continued)

(58) Field of Classification Search
CPC ..... F02M 61/1806; F02M 61/168; F02M 61/1826; F02M 61/1833; F02M 61/184; F02M 61/1853; Y10T 29/49
(Continued)

(56) References Cited

U.S. PATENT DOCUMENTS 3,532,271 A * 10/1970 Polnauer ..... B05B 1/3436 239/1
4,168,804 A 9/1979 Hofmann
(Continued)

FOREIGN PATENT DOCUMENTS

CH 340093 7/1959
DE 4404021 8/1995
(Continued)

OTHER PUBLICATIONS

International Search Report for PCT International Application No. PCT/US2013/053153 dated Oct. 14, 2013, 4 pages.
(Continued)

*Primary Examiner* — Chee-Chong Lee
*Assistant Examiner* — Christopher R Dandridge
(74) *Attorney, Agent, or Firm* — Harold C. Knecht, III

(57) ABSTRACT

Nozzles and method of making the same are disclosed. The disclosed nozzles have at least one nozzle through-hole therein, wherein the at least one nozzle through-hole exhibits a coefficient of discharge, $C_D$, of greater than about 0.50. Fuel injectors containing the nozzle are also disclosed. Methods of making and using nozzles and fuel injectors are further disclosed.

21 Claims, 5 Drawing Sheets

(52) U.S. Cl.
CPC .... *F02M 61/1826* (2013.01); *F02M 61/1833* (2013.01); *F02M 61/1853* (2013.01); *Y10T 29/49* (2015.01)

(58) Field of Classification Search
USPC ..... 239/533.12, 596
See application file for complete search history.

(56) References Cited

U.S. PATENT DOCUMENTS

| | | | | | |
|---|---|---|---|---|---|
| 4,621,772 | A * | 11/1986 | Blythe | F02M 51/0671 | 239/585.4 |
| 4,657,189 | A | 4/1987 | Iwata et al. | | |
| 4,923,169 | A * | 5/1990 | Grieb | B21D 53/16 | 251/118 |
| 5,127,156 | A | 7/1992 | Yokoyama | | |
| D373,334 | S | 9/1996 | Honda | | |
| 5,636,796 | A | 6/1997 | Oguma | | |
| 5,716,009 | A | 2/1998 | Ogihara | | |
| 5,730,368 | A | 3/1998 | Flik | | |
| 5,931,391 | A | 8/1999 | Tani et al. | | |
| 7,128,282 | B2 | 10/2006 | Okamoto | | |
| 7,143,709 | B2 | 12/2006 | Brennan | | |
| 7,159,802 | B2 | 1/2007 | Oomura | | |
| 7,191,961 | B2 | 3/2007 | Okamoto | | |
| 7,587,108 | B2 | 9/2009 | Carpenter | | |
| 8,447,157 | B2 | 5/2013 | Carpenter | | |
| 2002/0179748 | A1 | 12/2002 | Dantes | | |
| 2003/0024910 | A1* | 2/2003 | Horsting | B23K 26/0604 | 219/121.71 |
| 2003/0127540 | A1 | 7/2003 | Xu | | |
| 2004/0055562 | A1 | 3/2004 | Stewart | | |
| 2004/0104285 | A1 | 6/2004 | Okamoto | | |
| 2004/0178287 | A1* | 9/2004 | Okamoto | F02M 51/0671 | 239/596 |
| 2004/0262430 | A1 | 12/2004 | Joseph | | |
| 2005/0150979 | A1* | 7/2005 | Gokhale | F02M 61/1846 | 239/533.12 |
| 2006/0049286 | A1 | 3/2006 | Oomura | | |
| 2006/0097082 | A1 | 5/2006 | Goenka | | |
| 2006/0124772 | A1* | 6/2006 | Pourdeyhimi | D04H 18/04 | 239/533.14 |
| 2006/0131447 | A1* | 6/2006 | Masuda | F02M 61/08 | 239/533.2 |
| 2008/0105767 | A1 | 5/2008 | Fujii | | |
| 2009/0308953 | A1 | 12/2009 | Palestrant | | |
| 2011/0215177 | A1* | 9/2011 | Guerrassi | F02M 61/182 | 239/533.12 |
| 2012/0107556 | A1 | 5/2012 | Zhang | | |

FOREIGN PATENT DOCUMENTS

| | | | | |
|---|---|---|---|---|
| DE | 10109345 | 8/2001 | | |
| DE | 10307932 | 10/2004 | | |
| DE | 102004048131 | 4/2006 | | |
| DE | 102006000110 | 9/2006 | | |
| DE | 102006000243 | 11/2006 | | |
| DE | 102006033878 | 1/2008 | | |
| DE | 102006047136 | 4/2008 | | |
| EP | 0740071 | 10/1996 | | |
| EP | 1249600 | 10/2002 | | |
| EP | 1645749 | 4/2006 | | |
| EP | 1995448 | 11/2008 | | |
| FR | 456230 | 8/1913 | | |
| FR | 2872864 | 1/2006 | | |
| FR | 2910072 | 6/2008 | | |
| JP | 2002048034 | 2/2002 | | |
| JP | 2003293907 | 10/2003 | | |
| JP | 2003314286 | 11/2003 | | |
| JP | 2005282420 | 10/2005 | | |
| JP | 2007-231852 | 9/2007 | | |
| JP | 2009299561 | 12/2009 | | |
| WO | WO 2002-06664 | 1/2002 | | |
| WO | WO 2006-037683 | 4/2006 | | |
| WO | WO 2006-108729 | 10/2006 | | |
| WO | WO 2007-074385 | 7/2007 | | |
| WO | WO 2008-070625 | 6/2008 | | |
| WO | WO 2008-078038 | 7/2008 | | |
| WO | WO 2008-120086 | 10/2008 | | |
| WO | WO 2010-026478 | 3/2010 | | |
| WO | WO 2010/055103 | 5/2010 | | |
| WO | WO 2011-014607 | 2/2011 | | |
| WO | WO2011014607 | * 2/2011 | F02M 61/18 | |
| WO | WO 2012-058090 | 5/2012 | | |
| WO | WO 2012-058605 | 5/2012 | | |
| WO | WO 2012-084515 | 6/2012 | | |
| WO | WO 2012/089391 | 7/2012 | | |
| WO | WO 2012-106512 | 8/2012 | | |
| WO | WO 2013-003373 | 1/2013 | | |
| WO | WO 2013-067184 | 5/2013 | | |
| WO | WO 2014-022624 | 2/2014 | | |
| WO | WO 2014-022640 | 2/2014 | | |
| WO | WO 2014-022646 | 2/2014 | | |
| WO | WO 2014-022650 | 2/2014 | | |
| WO | WO 2014-100299 | 6/2014 | | |

OTHER PUBLICATIONS

Yao, Zengquan et al., "Design of a simple swirl nozzle," Environmental Protection for Electric Power, vol. 18, No. 2, pp. 1-4 and 7, Sep. 2002.

* cited by examiner

FUEL INJECTORS WITH IMPROVED COEFFICIENT OF FUEL DISCHARGE

CROSS REFERENCE TO RELATED APPLICATIONS

This application is a national stage filing under 35 U.S.C. 371 of PCT/US2013/053153, filed Aug. 1, 2013, which claims priority to U.S. Provisional Application No. 61/678,305, filed Aug. 1, 2012, the disclosures of which are incorporated by reference in their entireties herein.

FIELD OF THE INVENTION

This invention generally relates to nozzles suitable for use in a fuel injector for an internal combustion engine. The invention is further applicable to fuel injectors incorporating such nozzles. This invention also relates to methods of making such nozzles, as well as methods of making fuel injectors incorporating such nozzles. The invention further relates to methods of using nozzles and fuel injectors in vehicles.

BACKGROUND

There are three basic types of fuel injector systems. Those that use port fuel injection (PFI), gasoline direct injection (GDI), and direct injection (DI). While PFI and GDI use gasoline as the fuel, DI uses diesel fuel. Efforts continue to further develop fuel injector nozzles and fuel injection systems containing the same so as to potentially increase fuel efficiency and reduce hazardous emissions of internal combustion engines, as well as reduce the overall energy requirements of a vehicle comprising an internal combustion engine.

SUMMARY OF THE INVENTION

The present invention is directed to fuel injector nozzles. In one exemplary embodiment, the fuel injector nozzle comprises: an inlet face; an outlet face opposite the inlet face; and one or more nozzle through-holes, with each of the one or more nozzle through-holes comprising at least one inlet opening on the inlet face connected to at least one outlet opening on the outlet face by a cavity defined by an interior surface, each inlet opening having an inlet opening dimension or diameter, D, each outlet opening having an outlet opening dimension or diameter, d, and at least one nozzle through-hole exhibiting a coefficient of discharge, $C_D$, of greater than about 0.50 as calculated by the formula:

$$C_D = \frac{Q_{Outlet}}{A_{Outlet}\sqrt{\frac{2*(P_1 - P_2)}{\rho\left[1 - \left[\frac{A_{Outlet}}{A_{Inlet}}\right]^2\right]}}},$$

wherein:

$Q_{outlet}$ represents a volumetric flow rate of a fluid exiting the at least one outlet opening;

$A_{outlet}$ represents an outlet area of the at least one outlet opening;

$A_{inlet}$ represents an inlet area of the at least one inlet opening;

$P_1$ represents a first pressure along the at least one inlet opening;

$P_2$ represents a second pressure along the at least one outlet opening; and

ρ represents a density of a fluid exiting the at least one outlet opening, and wherein the maximum outlet opening diameter is about 200 μm.

In another exemplary embodiment, the fuel injector nozzle of the present invention comprises: an inlet face having an inlet surface area, $A_{inletsurface}$; an outlet face opposite the inlet face; and a plurality of nozzle through-holes, with each of the nozzle through-holes comprising at least one inlet opening on the inlet face connected to at least one outlet opening on the outlet face by a cavity defined by an interior surface, each inlet opening having an inlet opening area $A_{inlet}$, wherein said inlet face surface area $A_{inletsurface}$ comprises (i) the combined inlet opening area of said one or more nozzle through-holes n $A_{inlet}$ values, wherein n represents the number of inlet openings, and (ii) an inlet land area $A_{inletland}$, (i.e., $A_{inletsurface}=\Sigma A_{inlet}+A_{inletland}$) and the inlet land area defines 90.5% or less of the inlet face surface area.

The present invention is further directed to fuel injectors. In one exemplary embodiment, the fuel injector comprises any one of the herein-disclosed nozzles of the present invention incorporated therein.

The present invention is even further directed to fuel injection systems. In one exemplary embodiment, the fuel injection system comprises any one of the herein-disclosed nozzles or fuel injectors of the present invention incorporated therein.

The present invention is even further directed to vehicles. In one exemplary embodiment, the vehicle comprises any one of the herein-disclosed nozzles or fuel injectors or fuel injection systems of the present invention incorporated therein.

The present invention is even further directed to methods of using the herein-disclosed nozzles of the present invention. In one exemplary embodiment, the method of using a nozzle of the present invention comprises a method of reducing an overall energy requirement of a vehicle, wherein the method comprises: incorporating any one of the herein-disclosed nozzles into a fuel injector system of the vehicle.

In another exemplary embodiment, the method of using a nozzle of the present invention comprises a method of increasing an overall fuel efficiency of a vehicle, wherein the method comprises: incorporating any one of the herein-disclosed nozzles into a fuel injector system of the vehicle.

In yet another exemplary embodiment, the method of using a nozzle of the present invention comprises a method of maintaining a mass flow rate of a fluid through a fuel injector system of a vehicle while utilizing a reduced pressure within the fuel injector system, wherein the method comprises: incorporating any one of the herein-disclosed nozzles into the fuel injector system of the vehicle.

The present invention is also directed to methods of making fuel injector nozzles. In one exemplary embodiment, the method of making a fuel injector nozzle comprises making any one of the herein-disclosed fuel injector nozzles.

In yet another exemplary embodiment, the method of making a fuel injector nozzle comprises: forming a nozzle using one or more design parameters that increase an overall coefficient of discharge of the nozzle, the nozzle having an inlet face, an outlet face opposite the inlet face, and one or more nozzle through-holes, with each of the one or more nozzle through-holes comprising at least one inlet opening on the inlet face connected to at least one outlet opening on the outlet face by a cavity defined by an interior surface, each inlet opening having an inlet opening dimension or diameter, D, and each outlet opening having an outlet opening dimension or diameter, d, wherein at least one nozzle through-hole exhibits a coefficient of discharge, $C_D$, of greater than about 0.50 as calculated by the formula:

$$C_D = \frac{Q_{Outlet}}{A_{Outlet}\sqrt{\frac{2*(P_1 - P_2)}{\rho\left[1 - \left[\frac{A_{Outlet}}{A_{Inlet}}\right]^2\right]}}},$$

wherein:

$Q_{outlet}$ represents a volumetric flow rate of a fluid exiting the at least one outlet opening;

$A_{outlet}$ represents an outlet area of the at least one outlet opening;

$A_{inlet}$ represents an inlet area of the at least one inlet opening;

$P_1$ represents a first pressure along the at least one inlet opening;

$P_2$ represents a second pressure along the at least one outlet opening; and

ρ represents a density of a fluid exiting the at least one outlet opening.

The present invention is also directed to methods of making fuel injectors for use in an internal combustion engine of a vehicle. In one exemplary embodiment, the method of making a fuel injector comprises incorporating any one of the herein-described nozzles into the fuel injector.

The present invention is further directed to methods of making fuel injection systems of an internal combustion vehicle. In one exemplary embodiment, the method of making a fuel injection system of a vehicle comprises incorporating any one of the herein-described nozzles or fuel injectors into the fuel injection system.

BRIEF DESCRIPTION OF DRAWINGS

The invention may be more completely understood and appreciated in consideration of the following detailed description of various embodiments of the invention in connection with the accompanying drawings, in which.

In the specification, a same reference numeral used in multiple figures refers to the same or similar elements having the same or similar properties and functionalities.

DETAILED DESCRIPTION

Figure 1:
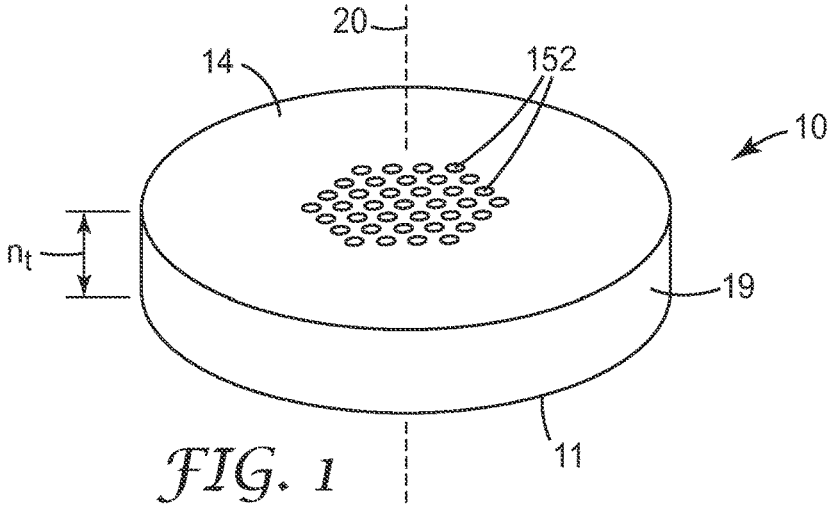
FIG. 1 is a perspective view of an exemplary nozzle of the present invention.

The disclosed nozzles represent improvements to nozzles disclosed in (1) International Patent Application Publication WO2011/014607, which published on Feb. 3, 2011, and (2) International Patent Application Serial No. US2012/023624 (entitled "Nozzle and Method of Making Same") filed on Feb. 2, 2012, the subject matter and disclosure of both of which are herein incorporated by reference in their entirety. The disclosed nozzles provide one or more advantages over prior nozzles as discussed herein. For example, the disclosed nozzles can advantageously be incorporated into fuel injector systems to improve fuel efficiency. The disclosed nozzles can be fabricated using multiphoton, such as two photon, processes like those disclosed in International Patent Application Publication WO2011/014607 and International Patent Application Serial No. US2012/023624. In particular, multiphoton processes can be used to fabricate various microstructures, which can at least include one or more hole forming features. Such hole forming features can, in turn, be used as molds to fabricate holes for use in nozzles or other applications.

It should be understood that the term "nozzle" may have a number of different meanings in the art. In some specific references, the term nozzle has a broad definition. For example, U.S. Patent Publication No. 2009/0308953 A1 (Palestrant et al.), discloses an "atomizing nozzle" which includes a number of elements, including an occluder chamber 50. This differs from the understanding and definition of nozzle put forth herewith. For example, the nozzle of the current description would correspond generally to the orifice insert 24 of Palestrant et al. In general, the nozzle of the current description can be understood as the final tapered portion of an atomizing spray system from which the spray is ultimately emitted, see e.g., Merriam Webster's dictionary definition of nozzle ("a short tube with a taper or constriction used (as on a hose) to speed up or direct a flow of fluid." Further understanding may be gained by reference to U.S. Pat. No. 5,716,009 (Ogihara et al.) issued to Nippondenso Co., Ltd. (Kariya, Japan). In this reference, again, fluid injection "nozzle" is defined broadly as the multi-piece valve element 10 ("fuel injection valve 10 acting as fluid injection nozzle . . . . "—see col. 4, lines 26-27 of Ogihara et al.). The current definition and understanding of the term "nozzle" as used herein would relate, e.g., to first and second orifice plates 130 and 132 and potentially sleeve 138 (see FIGS. 14 and 15 of Ogihara et al.), for example, which are located immediately proximate the fuel spray. A similar understanding of the term "nozzle" to that described herein is used in U.S. Pat. No. 5,127,156 (Yokoyama et al.) to Hitachi, Ltd. (Ibaraki, Japan). There, the nozzle 10 is defined separately from elements of the attached and integrated structure, such as "swirler" 12 (see FIG. 1(II)). The above-defined understanding should be understood when the term "nozzle" is referred to throughout the remainder of the description and claims.

FIGS. 1-9 depict various nozzles 10 of the present invention. The disclosed nozzles 10 include one or more nozzle through-holes 15 incorporated into the nozzle 10 structure, wherein at least one nozzle through-hole 15 exhibits a coefficient of discharge, $C_D$, of greater than about 0.50 (or any value greater than 0.50 up to but excluding 1.00 in increments of 0.01) as calculated by the formula:

$$C_D = \frac{Q_{Outlet}}{A_{Outlet}\sqrt{\frac{2*(P_1 - P_2)}{\rho\left[1 - \left[\frac{A_{Outlet}}{A_{Inlet}}\right]^2\right]}}},$$

wherein:

$Q_{outlet}$ represents a volumetric flow rate of a fluid exiting the at least one outlet opening 152;

$A_{outlet}$ represents an outlet area of the at least one outlet opening 152;

$A_{inlet}$ represents an inlet area of the at least one inlet opening 151;

$P_1$ represents a first pressure along the at least one inlet opening 151;

$P_2$ represents a second pressure along the at least one outlet opening 152; and ρ represents a density of a fluid exiting the at least one outlet opening 152, and wherein the maximum outlet opening diameter is about 200 μm. In some embodiments, two or more (or all) of the nozzle through-holes 15 of nozzle 10 exhibit a coefficient of discharge, $C_D$, of greater than about 0.50 (or any value greater than 0.50 up to but excluding 1.00 in increments of 0.01) as calculated by the above formula.

The one or more nozzle through-holes 15 provide one or more of the following properties to the nozzle 10: (1) the ability to provide variable fluid flow through a single nozzle through-hole 15 or through multiple nozzle through-holes 15 (e.g., the combination of increased fluid flow through one or more outlet openings 152 and decreased fluid flow through other outlet openings 152 of the same nozzle through-hole 15 or of multiple nozzle through-holes 15) by selectively designing individual cavity passages (i.e., cavity passages 153' discussed below) extending along a length of a given nozzle through-hole 15), (2) the ability to provide single-or multi-directional fluid flow relative to an outlet face 14 of the nozzle 10 via a single nozzle through-hole 15 or multiple nozzle through-holes 15, and (3) the ability to provide single-or multi-directional off-axis fluid flow relative to a central normal line 20 extending perpendicularly through the nozzle outlet face 14 via a single nozzle through-hole 15 or multiple nozzle through-holes 15.

Due to their nozzle through-hole 15 design, the disclosed nozzles 10 can advantageously be incorporated into fuel injector systems 100 so as to enhance one or more performance features of an internal combustion engine 106. For example, the disclosed nozzles 10, when incorporated into a fuel injector system 100 of an internal combustion engine 106 of a vehicle 200, provide one or more of the following performance features: (1) a reduction in an overall energy requirement of the vehicle 200, (2) an increase in an overall fuel efficiency of the vehicle 200, and (3) an ability to maintain a mass flow rate of a fluid through the fuel injector system 100 of the vehicle 200 while utilizing a reduced pressure within the fuel injector system 100 (e.g., a reduced pressure of at least 40% less (or at least 50% less, or at least 60% less) than a normal operating pressure within the fuel injector system of the vehicle.

FIGS. 1-2 and 4-9 depict various views of exemplary fuel injector nozzles 10 of the present invention. As shown in FIG. 1, exemplary fuel injector nozzle 10 comprises an inlet face 11; an outlet face 14 opposite inlet face 11; and at least one nozzle through-hole 15 comprising at least one inlet opening 151 on inlet face 11 connected to at least one outlet opening 152 on outlet face 14 by a cavity 153 defined by an interior surface 154. As shown in FIG. 1, in this exemplary nozzle 10, outlet face 14 has 37 outlet openings 152 thereon corresponding to 37 individual nozzle through-holes 15.

Figure 2:
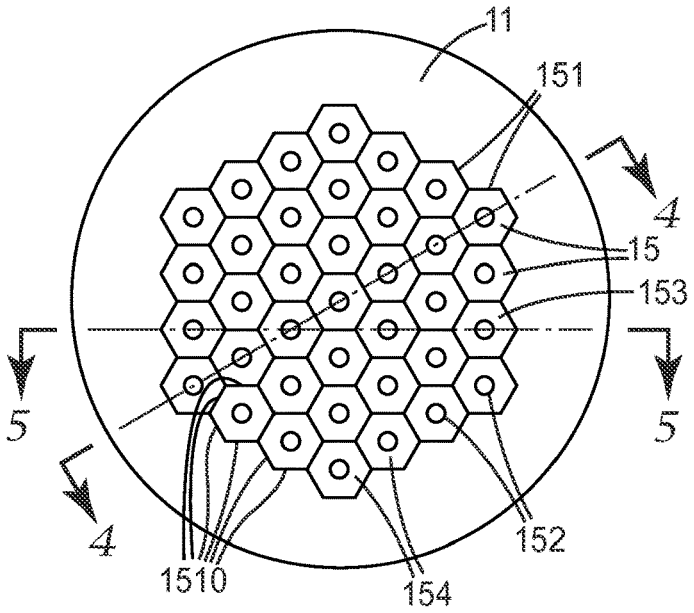
FIG. 2 is a view of an inlet face of the exemplary nozzle shown in FIG. 1.

As shown in FIG. 2, the 37 individual nozzle through-holes 15 are positioned along inlet face 11 so as to minimize an inlet land area between individual nozzle through-holes 15. In this embodiment, the inlet land area between individual nozzle through-holes 15 is represented by a line between adjacent inlet openings 151 on inlet face 11. Further, in this embodiment, individual nozzle through-holes 15 comprise hexagonal-shaped inlet openings 151 on inlet face 11 and circular-shaped one outlet openings 152 along outlet face 14. One or more or all of the nozzle through-holes may have inlet openings that are circular-shaped.

Figure 3:
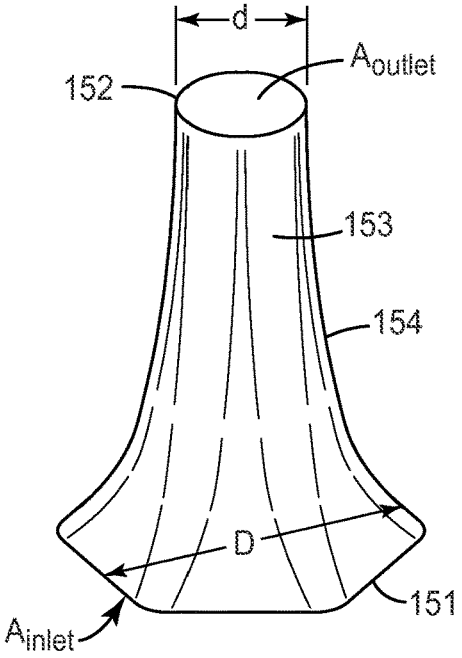
FIG. 3 is a perspective view of a single nozzle through-hole cavity of the exemplary nozzle shown in FIG. 1.
Figure 4:
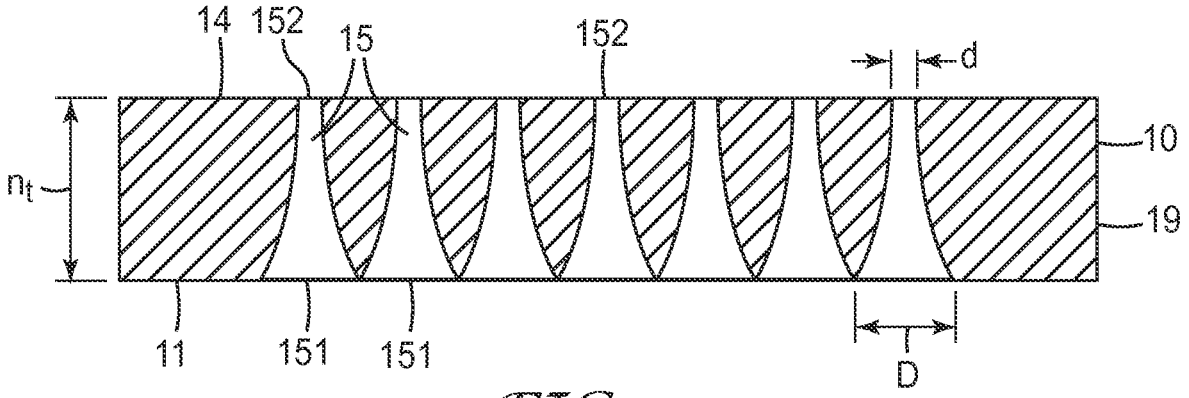
FIG. 4 is a cross-sectional view of the exemplary nozzle shown in FIG. 1 as viewed along line 4-4 shown in FIG. 2.
Figure 5:
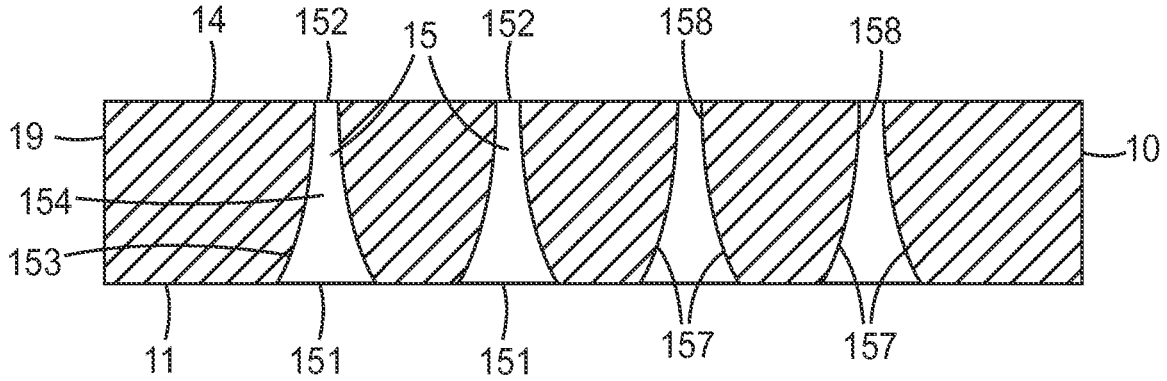
FIG. 5 is a cross-sectional view of the exemplary nozzle shown in FIG. 1 as viewed along line 5-5 shown in FIG. 2.

FIG. 3 depicts a perspective view of a single nozzle through-hole cavity 153 of the exemplary nozzle 10 shown in FIG. 1. Each individual nozzle through-hole cavity 153 may be designed to maximize a coefficient of discharge, $C_D$, of the individual nozzle through-hole cavity 153 and/or provide other features as discussed above (e.g., a desired volumetric fluid flow rate and/or directional fluid flow). For example, one or more of the following factors may be taken into account in order to maximize a coefficient of discharge, $C_D$, of an individual nozzle through-hole cavity 153 and in individual nozzle through-hole 15: selecting an overall length of a nozzle through-hole cavity 153 (L) and nozzle through-hole 15, selecting an overall thickness of nozzle 10 ($n_t$), removing any sharp edges between inlet surface 11 and cavity 153 of nozzle through-hole 15, selecting an angle of convergence between inlet surface 11 and cavity 153 of nozzle through-hole 15, eliminating any turbulence-causing structures along nozzle through-hole cavity 153, selecting a desired inlet opening 151 size and shape, selecting a desired outlet opening 152 size and shape, selecting a desired amount of curvature along internal surfaces 154 of cavity 153 (i.e., in particular, in a direction extending directly from inlet opening 151 to outlet opening 152) of nozzle through-hole 15, etc.

Figure 6:
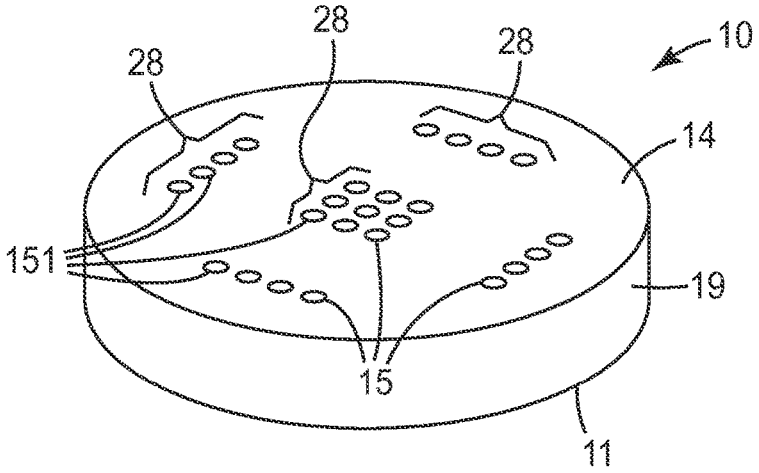
FIG. 6 is a perspective view of another exemplary nozzle of the present invention.

As shown in FIG. 6, nozzles 10 of the present invention may comprise one or more arrays 28, wherein each array 28 comprises one or more nozzle through-holes 15.

Figure 7:
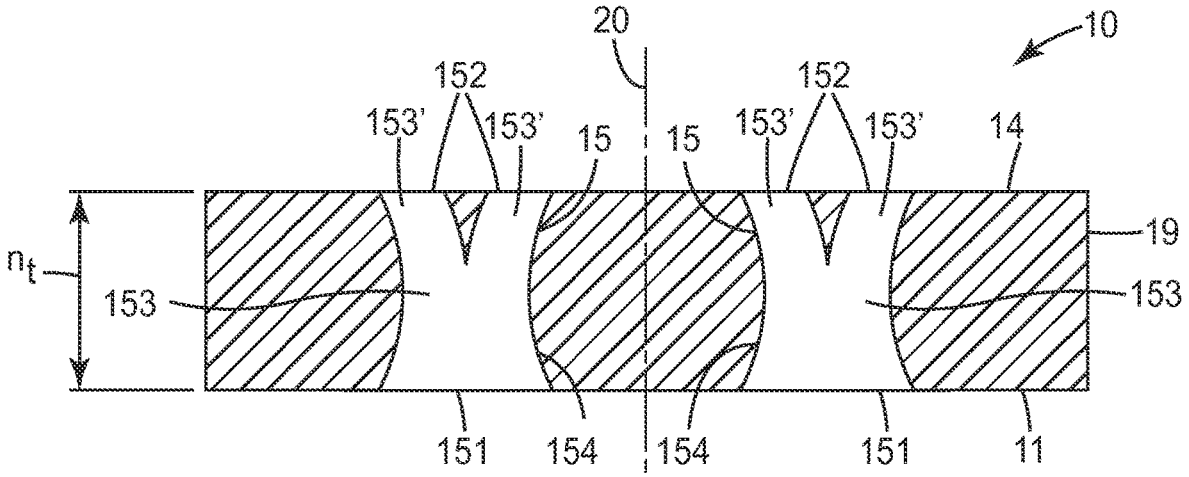
FIG. 7 is a cross-sectional view of another exemplary nozzle of the present invention.
Figure 8:
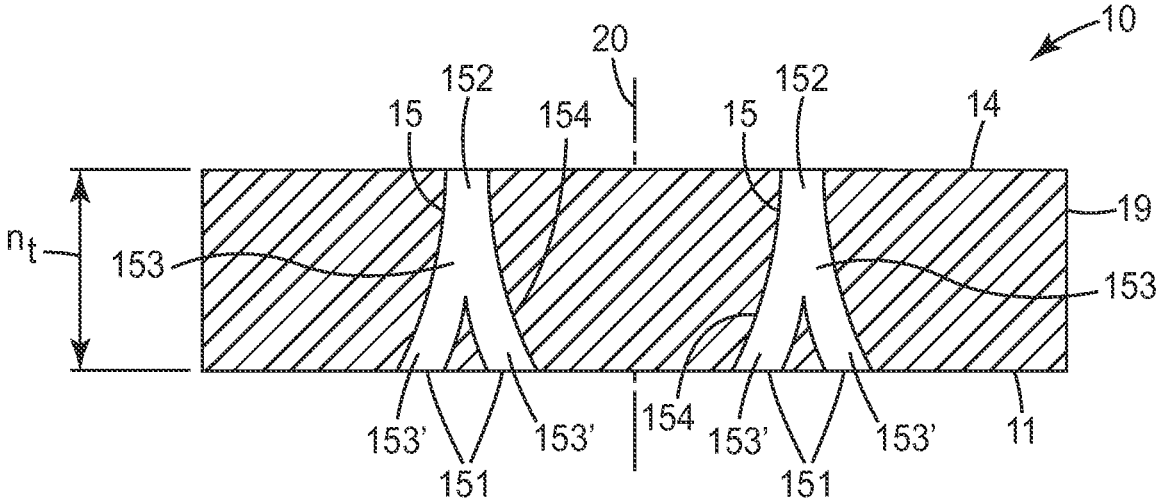
FIG. 8 is a cross-sectional view of another exemplary nozzle of the present invention.

As shown in FIGS. 7-8, nozzle through-holes 15 of exemplary nozzles 10 may comprise (i) a single inlet opening 151 connected to multiple outlet openings 152, or (ii) multiple inlet openings 151 connected to a single outlet opening 152. In these embodiments, multiple cavity passages 153' extending along cavity 153, wherein each cavity passage 153' leads to one outlet opening 152 or extends from one inlet opening 151.

Figure 9:
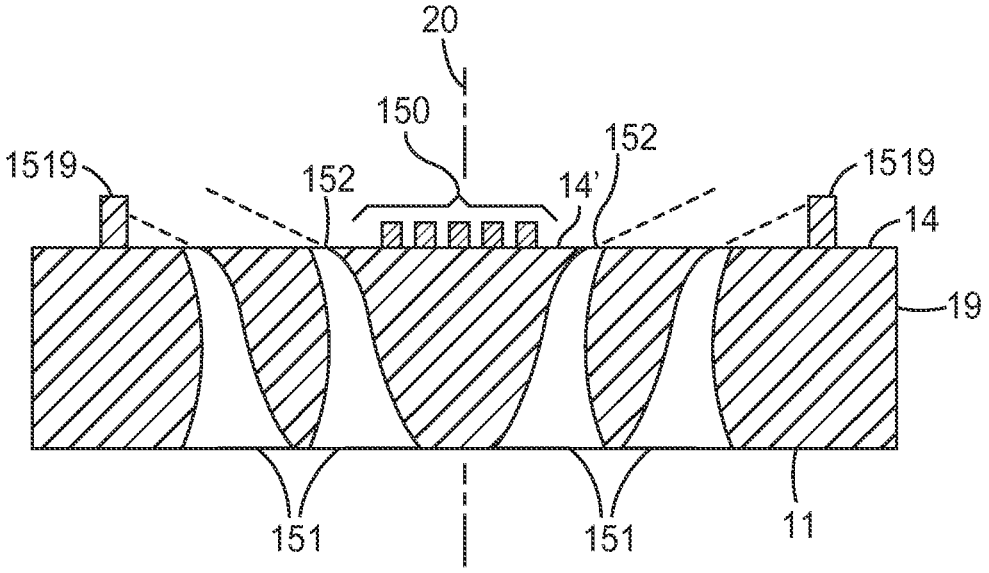
FIG. 9 is a cross-sectional view of another exemplary nozzle of the present invention.

As shown in FIG. 9, exemplary nozzles 10 of the present invention may further comprise a number of optional, additional features. Suitable optional, additional features include, but are not limited to, one or more anti-coking microstructures 150 positioned along any portion of outlet face 14, and one or more fluid impingement structures 1519 along any portion of outlet face 14.

As shown in FIGS. 1-9, nozzles 10 of the present invention may comprise one or more nozzle through-holes 15, wherein each nozzle through-hole 15 independently comprises the following features: (i) one or more inlet openings 151, each of which has its own independent shape and size, (ii) one or more outlet openings 152, each of which has its own independent shape and size, (iii) an internal surface 154 profile that may include one or more curved sections 157, one or more linear sections 158, or a combination of one or more curved sections 157 and one or more linear sections 158, (iv) an internal surface 154 profile that may include two or more cavity passages 153' extending from multiple inlet openings 151 and merging into a single cavity passage 153' extending to a single outlet opening 152, or a single cavity passages 153' extending from a single inlet opening 151 and separating into two or more cavity passages 153' extending to multiple outlet openings 152, and (v) a coefficient of discharge, $C_D$, as calculated by the above formula. Selection of these features for each independent nozzle through-hole 15 enables nozzle 10 to provide (1) substantially equal fluid flow through nozzle through-holes 15 (i.e., fluid flow that is essentially the same exiting each multiple outlet opening 152 of each of nozzle through-holes 15), (2) variable fluid flow through any one nozzle through-hole 15 (i.e., fluid flow that is not the same exiting the multiple outlet openings 152 of a given nozzle through-hole 15), (3) variable fluid flow through any two or more nozzle through-holes 15 (i.e., fluid flow that is not the same exiting the multiple outlet openings 152 of a given nozzle through-hole 15), (4) single-or multi-directional fluid streams exiting a single nozzle through-hole 15 or multiple nozzle through-holes 15, (5) linear and/or curved fluid streams exiting one or more nozzle through-holes 15, and (6) parallel and/or divergent and/or parallel followed by convergent fluid streams exiting one or more nozzle through-holes 15.

In some embodiments, at least one of nozzle through-holes 15 has an inlet opening 151 axis of flow, a cavity 153 axis of flow and an outlet opening 152 axis of flow, and at least one axis of flow is different from at least one other axis of flow. As used herein, the "axis of flow" is defined as the central axis of a stream of fuel as the fuel flows into, through or out of nozzle through-hole 15. In the case of a nozzle through-hole 15 having multiple inlet openings 151, multiple outlet openings 152 or both, the nozzle through-hole 15 can have a different axis of flow corresponding to each of the multiple openings 151/152.

In some embodiments, inlet opening 151 axis of flow may be different from outlet opening 152 axis of flow. In other embodiments, each of inlet opening 151 axis of flow, cavity 153 axis of flow and outlet opening 152 axis of flow is different from one another. In other embodiments, nozzle through-hole 15 has a cavity 153 that is operatively adapted (i.e., dimensioned, configured or otherwise designed) such that fuel flowing therethrough has an axis of flow that is curved.

Examples of factors that contribute to such differences in axis of flow may include, but are not be limited to, any combination of: (1) a different angle between (i) cavity 153 and (ii) inlet face 11 and/or outlet face 14, (2) inlet openings 151 and/or cavities 153 and/or outlet openings 152 not being aligned or parallel to each other, or being aligned along different directions, or being parallel but not aligned, or being intersecting but not aligned, and/or (3) any other conceivable geometric relationship two or three non-aligned line segments could have.

The disclosed nozzles 10 may comprise (or consist essentially of or consist of) any one of the disclosed nozzle features or any combination of two or more of the disclosed nozzle features. In addition, although not shown in the figures and/or described in detail herein, the nozzles 10 of the present invention may further comprise one or more nozzle features disclosed in (1) U.S. Provisional Patent Application Ser. No. 61/678,475 (entitled "GDI Fuel Injectors with Non-Coined Three-Dimensional Nozzle Outlet Face") filed on Aug. 1, 2012 (e.g., outlet face overlapping features 149), (2) U.S. Provisional Patent Application Ser. No. 61/678,356 (entitled "Targeting of Fuel Output by Off-Axis Directing of Nozzle Output Streams") filed on Aug. 1, 2012 (e.g., specifically disclosed nozzle through-holes 15 and/or inlet face features 118 that reduce a SAC volume of a fuel injector), (3) U.S. Provisional Patent Application Ser. No. 61/678,330 (entitled "Fuel Injector Nozzles with at Least One Multiple Inlet Port and/or Multiple Outlet Port") filed on Aug. 1, 2012 (e.g., nozzle through-holes 15 having multiple inlet openings 151, multiple outlet openings 152, or both, and fuel injectors 101 and fuel injection systems 100 containing the same), and (4) U.S. Provisional Patent Application Ser. No. 61/678,288 (entitled "Fuel Injectors with Non-Coined Three-dimensional Nozzle Inlet Face") filed on Aug. 1, 2012 (e.g., a non-coined three-dimensional inlet face 11), the subject matter and disclosure of each of which is herein incorporated by reference in its entirety.

The disclosed nozzles 10 may be formed using any method as long as the resulting nozzle 10 has (i) one or more nozzle through-holes 15 therein, and at least one nozzle through-hole 15 has a coefficient of discharge as described herein and/or (ii) a plurality of nozzle through-holes 15 with an inlet land area configuration as described herein. Although suitable methods of making nozzles 10 of the present invention are not limited to the methods disclosed in International Patent Application Serial No. US2012/023624, nozzles 10 of the present invention may be formed using the methods (e.g., a multiphoton process, such as a two photon process) disclosed in International Patent Application Serial No. US2012/023624. See, in particular, the method steps described in reference to FIGS. 1A-1M of International Patent Application Serial No. US2012/023624.

Additional Embodiments

Nozzle Embodiments

1. A fuel injector nozzle 10 comprising: an inlet face 11; an outlet face 14 opposite said inlet face 11; and one or more nozzle through-holes 15, with each of said one or more nozzle through-holes 15 comprising at least one inlet opening 151 on said inlet face 11 connected to at least one outlet opening 152 on said outlet face 14 by a cavity 153 defined by an interior surface 154, each said inlet opening 151 having an inlet opening dimension or diameter, D, each said outlet opening 152 having an outlet opening dimension or diameter, d, and at least one said nozzle through-hole 15 exhibiting a coefficient of discharge, $C_D$, in the range of from greater than about 0.50, and in increments of about 0.01 (i.e., 0.51, 0.52, 0.53, 0.54, 0.55, 0.56, 0.57, 0.58, 0.59, 0.60, 0.61, 0.62, 0.63, 0.64, 0.65, 0.66, 0.67, 0.68, 0.69, 0.70, 0.71, 0.72, 0.73, 0.74, 0.75, 0.76, 0.77, 0.78, 0.79, 0.80, 0.81, 0.82, 0.83, 0.84, 0.85, 0.86, 0.87, 0.88, 0.89, 0.90, 0.91, 0.92, 0.93, 0.94, 0.95, 0.96, 0.97, 0.98, 0.99) up to but not including 1.00, and any range therebetween. It is desirable for the $C_D$ of the nozzle to be at least about 0.70, and in increments of about 0.01, up to but not including 1.0, and any range therebetween, as calculated by the formula:

$$C_D = \frac{Q_{Outlet}}{A_{Outlet}\sqrt{\frac{2*(P_1 - P_2)}{\rho\left[1 - \left[\frac{A_{Outlet}}{A_{Inlet}}\right]^2\right]}}},$$

wherein:

$Q_{outlet}$ represents a volumetric flow rate of a fluid (not shown) exiting said at least one outlet opening 152;

$A_{outlet}$ represents an outlet area of said at least one outlet opening 152;

$A_{inet}$ represents an inlet area of said at least one inlet opening 151;

$P_1$ represents a first pressure along said at least one inlet opening 151;

$P_2$ represents a second pressure along said at least one outlet opening 152; and ρ represents a density of a fluid exiting said at least one outlet opening 152. It is preferable for the maximum outlet opening diameter for outlet openings 152 of nozzles 10 to be about 200 μm (or, in increments of about 5 μm, down to and including about 10 μm, and any maximum therebetween or any range therebetween).

2. A fuel injector nozzle 10 comprising: an inlet face 11 having an inlet surface area, $A_{inletsurface}$; an outlet face 14 opposite said inlet face 11; and a plurality of nozzle through-holes 15, with each of said nozzle through-holes 15 comprising at least one inlet opening 151 on said inlet face 11 connected to at least one outlet opening 152 on said outlet face 14 by a cavity 153 defined by an interior surface 154, each said inlet opening 151 having an inlet opening area $A_{inlet}$, each said outlet opening 152 having an outlet opening area, $A_{outlet}$, wherein said inlet face surface area $A_{inletsurface}$ is defined by, consists of, or at least comprises (i) the combined inlet opening area of said one or more nozzle through-holes (i.e., the combined areas of all of the inlet openings, namely, the sum of n $A_{inlet}$ values, wherein n represents the number of inlet openings 151) and (ii) an inlet land area, $A_{inletland}$, $A_{inletsurface}=\Sigma A_{inlet}+A_{inletland}$) and said inlet land area defines 90.5% or less (or any percentage or range of percentages below 90.5% in increments of 0.1%) of said inlet face surface area.
3. The nozzle 10 of embodiment 2, wherein said combined inlet opening area defines 9.5% or more (or any percentage or range of percentages above 9.5% and below 90.5% in increments of 0.1%) of said inlet face surface area.
4. The nozzle 10 of embodiment 2 or 3, wherein said inlet land area defines about 90% or less (or any percentage or range of percentages below 90% in increments of 0.1%) of said inlet face surface area.
5. The nozzle 10 of embodiment 4, wherein said combined inlet opening area defines about 10% or more (or any percentage or range of percentages above 10% and below 90.5% in increments of 0.1%) of said inlet face surface area.
6. The nozzle 10 of any one of embodiments 2 to 5, wherein said inlet land area defines 74.5% or less (or any percentage or range of percentages below 74.5% in increments of 0.1%) of said inlet face surface area.
7. The nozzle 10 of embodiment 6, wherein said combined inlet opening area defines 25.5% or more (or any percentage or range of percentages above 25.5% and below 74.5% in increments of 0.1%) of said inlet face surface area.
8. The nozzle 10 of any one of embodiments 2 to 7, wherein said inlet land area defines about 74% or less (or any percentage or range of percentages below 74% in increments of 0.1%) of said inlet face surface area.
9. The nozzle 10 of embodiment 8, wherein said combined inlet opening area defines about 26% or more (or any percentage or range of percentages above 26% and below 74% in increments of 0.1%) of said inlet face surface area.
10. The nozzle 10 of any one of embodiments 2 to 9, wherein each said outlet opening 152 has an outlet opening area, said outlet face 14 has an outlet surface area defined by, consisting of, or at least comprising the combined outlet opening area (i.e., the combined areas of all of the outlet openings) of said nozzle through-holes 15 and an outlet land area, and said combined outlet opening area is less than said combined inlet opening area.
11. The nozzle 10 of embodiment 10, wherein said combined outlet opening area is in the range of from about 50%, and in increments of about 0.01, down to and including about 0.5% of said combined inlet opening area, and any range therebetween.
12. The nozzle 10 of embodiment 11, wherein said combined outlet opening area is less than about 6.80% (or any percentage or range of percentages below 6.80% in increments of 0.01%) of said combined inlet opening area.
13. The nozzle 10 of any one of embodiments 2 to 12, wherein at least one said nozzle through-hole 15 exhibits a coefficient of discharge, $C_D$, in the range of from greater than about 0.50, and in increments of about 0.01, up to but not including 1.00, and any range therebetween. It is desirable for the $C_D$ of the nozzle 10 to be at least about or above 0.70, and in increments of about 0.01, up to but not including 1.0, and any range therebetween, as calculated by the formula:

$$C_D = \frac{Q_{Outlet}}{A_{Outlet}\sqrt{\frac{2*(P_1-P_2)}{\rho\left[1-\left[\frac{A_{Outlet}}{A_{Inlet}}\right]^2\right]}}}$$

wherein:

$Q_{outlet}$ represents a volumetric flow rate of a fluid (not shown) exiting said at least one outlet opening 152;

$A_{outlet}$ represents an outlet area of said at least one outlet opening 152;

$A_{inlet}$ represents an inlet area of said at least one inlet opening 151;

$P_1$ represents a first pressure along said at least one inlet opening 151;

$P_2$ represents a second pressure along said at least one outlet opening 152; and ρ represents a density of a fluid exiting said at least one outlet opening 152.

14. The nozzle 10 of any one of embodiments 1 to 13, wherein each nozzle through-hole 15 has a coefficient of discharge, $C_D$, of at least about 0.70 (or any amount up to but not including 1.00 in increments of 0.01 or any range therebetween).
15. The nozzle 10 of any one of embodiments 1 to 14, wherein each nozzle through-hole 15 has a coefficient of discharge, $C_D$, of greater than about 0.75 (or any amount up to but not including 1.00 in increments of 0.01 or any range therebetween).
16. The nozzle 10 of any one of embodiments 1 to 15, wherein each nozzle through-hole 15 has a coefficient of discharge, $C_D$, of greater than about 0.80 (or any amount up to but not including 1.00 in increments of 0.01 or any range therebetween).
17. The nozzle 10 of any one of embodiments 1 to 16, wherein each nozzle through-hole 15 has a coefficient of discharge, $C_D$, of greater than about 0.90 (or any amount up to but not including 1.00 in increments of 0.01 or any range therebetween).
18. The nozzle 10 of any one of embodiments 1 to 17, wherein each nozzle through-hole 15 has an inlet opening diameter, D, of up to about 500 microns (μm), and in increments of about 5 μm, down to and including about 50 μm, and any maximum therebetween.

19. The nozzle 10 of any one of embodiments 1 to 18, wherein each nozzle through-hole 15 has an inlet opening diameter, D, of from about 50 μm to about 500 μm, and in increments of about 5 μm, and any range therebetween 20. The nozzle 10 of any one of embodiments 1 to 19, wherein each nozzle through-hole 15 has an outlet opening diameter, d, of up to about 200 microns (μm) (and in increments of about 1.0 μm, down to and including about 10 μm, and any range therebetween).

21. The nozzle 10 of any one of embodiments 1 to 20, wherein each nozzle through-hole 15 has an outlet opening diameter, d, of from about 10 μm to about 200 μm (and any diameter value or range therebetween, in increments of about 1.0 μm).

22. The nozzle 10 of any one of embodiments 1 to 21, wherein each nozzle through-hole 15 has a d/D value of from about 0.02 to about 0.9 (or any value or range therebetween in increments of 0.01).

23. The nozzle 10 of any one of embodiments 1 to 22, wherein each nozzle through-hole 15 has a nozzle length, $n_t$, (i.e., the thickness of the nozzle plate where each nozzle through-hole is formed is) of up to about 3000 μm (and any value above about 100 μm or any range between 100 μm and 3000 μm, in increments of about 1.0 μm).

24. The nozzle 10 of any one of embodiments 1 to 23, wherein each nozzle through-hole 15 has a nozzle length of from about 100 μm to about 1500 μm (and any value or any range therebetween, in increments of about 1.0 μm).

25. The nozzle 10 of any one of embodiments 1 to 24, wherein said nozzle 10 comprises from 2 to 650 (or any number or range therebetween, in increments of 1) of said nozzle through-holes 15, or at least 4 of said nozzle through-holes 15.

26. The nozzle 10 of any one of embodiments 1 to 24, wherein said nozzle 10 comprises at least 58 (or any number or range above 58 up to about 1000, in increments of 1) of said nozzle through-holes 15.

27. The nozzle 10 of any one of embodiments 1 to 26, wherein each nozzle through-hole 15 has a curved surface profile 157 directly extending along its interior surface 154 from its at least one inlet opening 151 to its at least one outlet opening 152.

28. The nozzle 10 of embodiment 27, wherein said curved surface profile 157 has a radius of curvature of at least 10 μm along at least a portion thereof.

29. The nozzle 10 of embodiment 27, wherein said curved surface profile 157 has a radius of curvature in the range of from about 10 μm to about 4 m, and any value or range therebetween, along at least a portion thereof, in increments of 1.0 μm.

30. The nozzle 10 of any one of embodiments 27 to 29, wherein the curved surface profile 157 of each nozzle through-hole 15 extends a direct distance that is the shortest along its interior surface 154 from its at least one inlet opening 151 to its at least one outlet opening 152.

31. The nozzle 10 of any one of embodiments 27 to 29, wherein the curved surface profile 157 of each nozzle through-hole 15 extends a direct distance that is the longest along its interior surface 154 from its at least one inlet opening 151 to its at least one outlet opening 152.

32. The nozzle 10 of any one of embodiments 1 to 31, wherein at least one nozzle through-hole 15 has an inlet opening 151 and an outlet opening 152 having a similar shape.

33. The nozzle 10 of any one of embodiments 1 to 32, wherein at least one nozzle through-hole 15 has an inlet opening 151 and an outlet opening 152 having a different shape.

34. The nozzle 10 of any one of embodiments 1 to 33, wherein at least one nozzle through-hole 15 has a polygon shaped inlet opening 151 with at least three side edges 1510 (e.g., a triangle), at least four side edges (e.g., a quadrilateral), or at least six side edges (e.g., a hexagon) extending along said inlet surface 11.

35. The nozzle 10 of any one of embodiments 1 to 34, wherein at least one nozzle through-hole 15 has a polygon shaped inlet opening 151 within the range of from four to twelve side edges 1510 (or any number or range therebetween in increments of 1) extending along said inlet surface 11.

36. The nozzle 10 of any one of embodiments 1 to 35, wherein at least one nozzle through-hole 15 has an outlet opening 152 with a circular shape.

37. The nozzle 10 of any one of embodiments 1 to 31 and 33 to 36, wherein at least one nozzle through-hole 15 has an inlet opening 151 with side edges 1510 in a hexagonal shape and an outlet opening 152 having a circular shape.

38. The nozzle 10 of any one of embodiments 1 to 37, wherein there is no inlet land area (or at most, a minimum amount of inlet land area, e.g., a line) between any two adjacent inlet openings 151.

39. The nozzle 10 of any one of embodiments 1 to 31 and 33 to 38, wherein said nozzle 10 comprises a plurality of nozzle through-holes 15, each nozzle through-hole has an inlet opening 151 with side edges 1510 in a hexagonal shape and an outlet opening 152 having a circular shape, and each of at least three, and preferably all six, side edges 1510 of each inlet opening 151 defines a side edge 1510 for two inlet openings 151.

40. The nozzle 10 of any one of embodiments 1 to 37, wherein said inlet surface 11 comprises an inlet land area portion between adjacent inlet openings 151, and the distance between adjacent inlet openings 151 is in the range of from about 1.0 μm to about 200 μm (or any value or range therebetween in increments of 1.0 μm), and preferably in the range of from about 0 μm to less than about 10 μm (or any value or range therebetween in increments of 0.1 μm).

41. The nozzle 10 of any one of embodiments 1 to 40, wherein said nozzle through-holes 15 form two sets 28 of nozzle through-holes 15, and each set 28 of nozzle through-holes 15 defines a separate pattern of nozzles through-holes 15.

42. The nozzle 10 of any one of embodiments 1 to 41, wherein at least one nozzle through-hole 15 comprises two or more outlet openings 152.

43. The nozzle 10 of any one of embodiments 1 to 41, wherein at least one nozzle through-hole 15 comprises two or more inlet openings 151.

44. The nozzle 10 of any one of embodiments 1 to 43, wherein said cavity 153 of at least one nozzle through-hole 15 comprises multiple cavity passages 153' extending along a length of said cavity 153.

45. The nozzle 10 of embodiment 41, wherein each set 28 of nozzle through-holes 15 comprises in the range of from 4 to 24 nozzle through-holes 15 (or any number or range therebetween in increments of 1).

46. The nozzle 10 of any one of embodiments 1 to 45, wherein said outlet face 14 further comprises an outlet surface 14' with anti-coking nanostructures 150 thereon.

47. The nozzle 10 of any one of embodiments 1 to 46, wherein said nozzle 10 further comprises one or more fluid impingement members 1519 positioned along said outlet face 14.
48. The nozzle 10 of any one of embodiments 1 to 47, wherein the nozzle 10 comprises a metallic material, an inorganic non-metallic material (e.g., a ceramic), or a combination thereof.
49. The nozzle 10 of any one of embodiments 1 to 48, wherein the nozzle 10 comprises a ceramic selected from the group comprising silica, zirconia, alumina, titania, or oxides of yttrium, strontium, barium, hafnium, niobium, tantalum, tungsten, bismuth, molybdenum, tin, zinc, lanthanide elements having atomic numbers ranging from 57 to 71, cerium and combinations thereof.
50. The nozzle 10 of any one of embodiments 1 to 49, wherein said nozzle through-holes 15 direct fluid at one or more separate independent locations relative to a nozzle central axis 20 extending along a normal line perpendicular to said outlet face 14.
51. The nozzle 10 of any one of embodiments 1 to 50, wherein said nozzle through-holes 15 direct fluid at one or more separate independent off-axis locations relative to a nozzle central axis 20 extending along a normal line perpendicular to said outlet face 14.
52. The nozzle 10 of any one of embodiments 1 to 51, wherein said nozzle through-holes 15 comprises two or more nozzle through-holes 15 that direct substantially parallel non-converging fluid streams at one or more separate independent off-axis locations relative to a nozzle central axis 20 extending along a normal line perpendicular to said outlet face 14.
53. The nozzle 10 of any one of embodiments 1 to 52, wherein said nozzle through-holes 15 comprises two or more nozzle through-holes 15 that direct substantially parallel non-converging fluid streams at two or more separate independent off-axis locations relative to a nozzle central axis 20 extending along a normal line perpendicular to said outlet face 14.
54. The nozzle 10 of any one of embodiments 1 to 53, wherein portions of said inlet face 11 and said outlet face 14 are substantially parallel with one another.
55. The nozzle 10 of any one of embodiments 1 to 54, wherein said nozzle 10 is a nozzle plate 10 having a substantially flat configuration.

Fuel Injector Embodiments

56. A fuel injector 101 comprising the nozzle 10 according to any one of embodiments 1 to 55.

Fuel Injector System Embodiments

Figure 10:
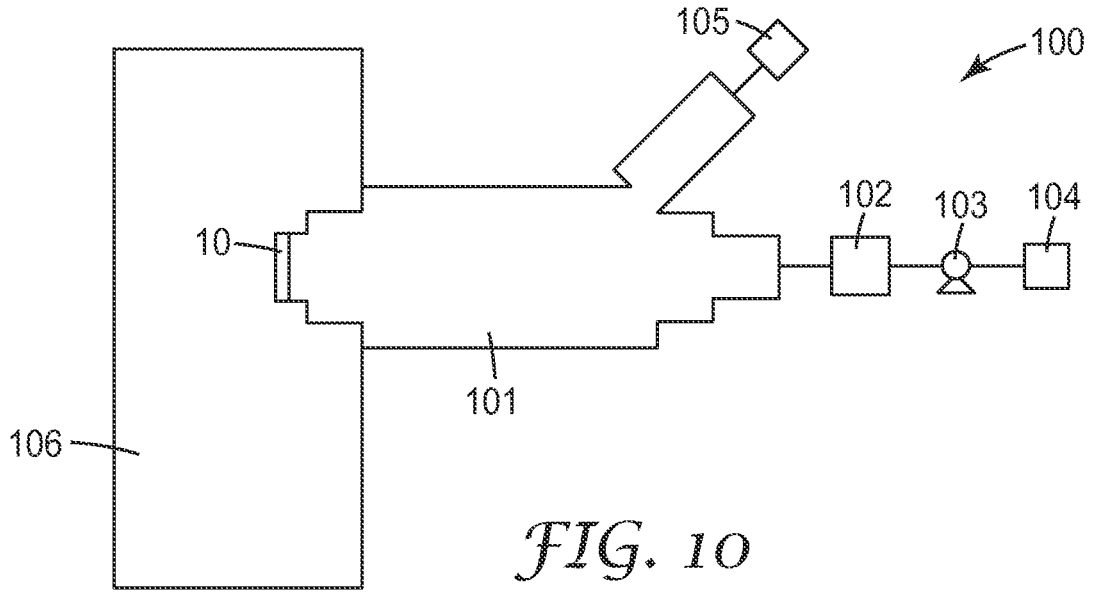
FIG. 10 is a schematic view of an exemplary fuel injection system of the present invention.
Figure 11:
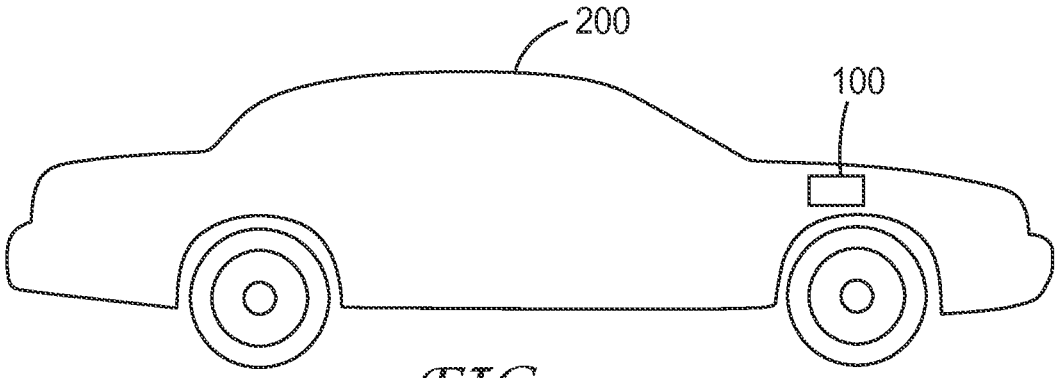
FIG. 11 is a view of a vehicle comprising the exemplary fuel injection system shown in FIG. 10.

57. A fuel injector system 100 comprising the fuel injector 101 of embodiment 56. (The fuel injector system 100 comprising, inter alia, fuel injector 101, fuel source/tank 104, fuel pump 103, fuel filter 102, fuel injector electrical source 105, and engine 106 as shown in FIG. 10.)

Vehicle Embodiments

58. A vehicle 200 comprising the nozzle 10 of any one of embodiments 1 to 55, the fuel injector 101 of embodiment 56, or the fuel injector system 100 of embodiment 57.

Methods of Using Nozzles Embodiments

59. A method of reducing an overall energy requirement of a vehicle 200, said method comprising: incorporating the nozzle 10 of any one of embodiments 1 to 55 into a fuel injector system 100 of the vehicle 200.
60. A method of increasing an overall fuel efficiency of a vehicle 200, said method comprising: incorporating the nozzle 10 of any one of embodiments 1 to 55 into a fuel injector system 100 of the vehicle 200.
61. A method of maintaining a mass flow rate of a fluid through a fuel injector system 101 of a vehicle 200 while utilizing a reduced pressure within the fuel injector system 101, said method comprising: incorporating the nozzle 10 of any one of embodiments 1 to 55 into the fuel injector system 100 of the vehicle 200.
62. The method of embodiment 61, wherein the reduced pressure is at least 40% less (or any percentage up to about 80% or any range of percentages therebetween in increments of 1%) than a normal operating pressure within the fuel injector system 100 of the vehicle 200.
63. The method of embodiment 61 or 62, wherein the reduced pressure is at least 50% less (or any percentage up to about 80% or any range of percentages therebetween in increments of 1%) than a normal operating pressure within the fuel injector system 100 of the vehicle 200.
64. The method of any one of embodiments 61 to 63, wherein the reduced pressure is at least 60% less (or any percentage up to about 80% or any range of percentages therebetween in increments of 1%) than a normal operating pressure within the fuel injector system 100 of the vehicle 200.

Methods of Making Nozzles Embodiments

65. A method of making the nozzle 10 of any one of embodiments 1 to 55.
66. A method of making a fuel injector nozzle 10, said method comprising: forming a nozzle 10 using one or more design parameters that increase an overall coefficient of discharge of the nozzle 10, the nozzle 10 having an inlet face 11, an outlet face 14 opposite the inlet face 11, and one or more nozzle through-holes 15, with each of the one or more nozzle through-holes 15 comprising at least one inlet opening 151 on the inlet face 11 connected to at least one outlet opening 152 on the outlet face 14 by a cavity 153 defined by an interior surface 154, each inlet opening 151 having an inlet opening dimension or diameter, D, and each outlet opening 152 having an outlet opening dimension or diameter, d, wherein at least one nozzle through-hole 15 exhibits a coefficient of discharge, $C_D$, in the range of from greater than about 0.50, and in increments of about 0.01 (i.e., 0.51, 0.52, 0.53, 0.54, 0.55, 0.56, 0.57, 0.58, 0.59, 0.60, 0.61, 0.62, 0.63, 0.64, 0.65, 0.66, 0.67, 0.68, 0.69, 0.70, 0.71, 0.72, 0.73, 0.74, 0.75, 0.76, 0.77, 0.78, 0.79, 0.80, 0.81, 0.82, 0.83, 0.84, 0.85, 0.86, 0.87, 0.88, 0.89, 0.90, 0.91, 0.92, 0.93, 0.94, 0.95, 0.96, 0.97, 0.98, 0.99) up to but not including 1.00, and any range therebetween. It is desirable for the $C_D$ of the nozzle to be at least about 0.70, and in increments of about 0.01, up to but not including 1.0, and any range therebetween, as measured by the formula:

$$C_D = \frac{Q_{Outlet}}{A_{Outlet}\sqrt{\frac{2*(P_1 - P_2)}{\rho\left[1 - \left[\frac{A_{Outlet}}{A_{Inlet}}\right]^2\right]}}},$$

wherein:

$Q_{outlet}$ represents a volumetric flow rate of a fluid exiting said at least one outlet opening 152;

$A_{outlet}$ represents an outlet area of said at least one outlet opening 152;

$A_{inlet}$ represents an inlet area of said at least one inlet opening 151;

$P_1$ represents a first pressure along said at least one inlet opening 151;

$P_2$ represents a second pressure along said at least one outlet opening 152; and ρ represents a density of a fluid exiting said at least one outlet opening 152.

67. The method of embodiment 66, wherein the one or more design parameters comprise (but are not limited to) (i) elimination or minimization of sharp edges from the inlet face 11 to the outlet face 14 of the nozzle 10, (ii) selecting values of D and d, (iii) selecting an overall length (i.e., thickness of nozzle plate, $n_t$) of the at least one nozzle through-hole 15, (iv) selecting an angle of convergence for the at least one nozzle through-hole 15, the angle of convergence being an angle between the inlet face 11 and the interior surface 154 of the at least one nozzle through-hole 15, (v) selecting a curve profile 157 for the at least one nozzle through-hole 15, (vi) minimizing an inlet land area on a portion of the inlet face 11 exposed to a ball valve outlet of a fuel injector system 100, and (vii) minimizing an inlet land area between adjacent nozzle through-holes 15.
68. The method of embodiment 66 or 67, said forming step comprising: applying nozzle-forming material over a nozzle forming microstructured pattern comprising one or more nozzle hole forming features; separating the nozzle-forming material from the nozzle forming microstructured pattern to provide a nozzle 15; and removing material, as needed, from the nozzle 10 to form one or more nozzle through-holes 15.
69. The method of embodiment 68, wherein the nozzle forming microstructured pattern further comprises one or more planar control cavity forming features.
70. The method of embodiment 68 or 69, said forming step further comprising: providing a microstructured mold pattern defining at least a portion of a mold and comprising one or more replica nozzle holes; and molding a first material onto the microstructured mold pattern so as to form the nozzle forming microstructured pattern.
71. The method of embodiment 70, wherein the microstructured mold pattern comprises at least one fluid channel feature connecting at least one replica nozzle hole to (a) at least one other replica nozzle hole, (b) a portion of the mold beyond the outer periphery of the microstructured mold pattern, or (c) both (a) and (b).
72. The method of any one of embodiments 68 to 71, wherein said removing step forms one or more outlet openings 152.

Nozzle Pre-Form Embodiments

73. A nozzle pre-form suitable for forming the nozzle 10 of any one of embodiments 1 to 55. See, for example, other nozzle pre-forms and how the nozzle pre-forms are utilized to form nozzles in FIGS. 1A-1M and the description thereof in International Patent Application Serial No. US2012/023624.

Microstructured Pattern Embodiments

74. A microstructured pattern suitable for forming the nozzle 10 of any one of embodiments 1 to 55. See, for example, other microstructured patterns and how the microstructured patterns are utilized to form nozzles in FIGS. 1A-1M and the description thereof in International Patent Application Serial No. US2012/023624.

In any of the above embodiments, nozzle 10 may comprise a nozzle plate 10 having a substantially flat configuration typically with at least a portion of inlet face 11 substantially parallel to at least a portion of outlet face 14.

Desirably, nozzles 10 of the present invention each independently comprise a monolithic structure. As used herein, the term "monolithic" refers to a nozzle having a single, integrally formed structure, as oppose to multiple parts or components being combined with one another to form a nozzle.

It can be desirable for the thickness of a fuel injector nozzle 10 to be at least about 100 μm, preferably greater than about 200 μm; and less than about 3 mm, preferably less than about 1 mm, more preferably less than about 500 μm (or any thickness between about 100 μm and about 3 mm in increments of 1.0 μm).

Further, although not shown in the figures, any of the herein-described nozzles 10 may further comprise one or more alignment surface features that enable (1) alignment of nozzle 10 (i.e., in the x-y plane) relative to a fuel injector 101 and (2) rotational alignment/orientation of nozzle 10 (i.e., a proper rotational position within the x-y plane) relative to a fuel injector 101. The one or more alignment surface features aid in positioning nozzle 10 and nozzle through-holes 15 therein so as to be accurately and precisely directed at one or more target location $l_t$ as discussed above. The one or more alignment surface features on nozzle 10 may be present along inlet face 11, outlet face 14, periphery 19, or any combination of inlet face 11, outlet face 14 and periphery 19. Further, the one or more alignment surface features on nozzle 10 may comprise, but are not limited to, a visual marking, an indentation within nozzle 10, a raised surface portion along nozzle 10, or any combination of such alignment surface features.

It should be understood that although the above-described nozzles, nozzle plates, fuel injectors, fuel injector systems, and methods are described as "comprising" one or more components, features or steps, the above-described nozzles, nozzle plates, fuel injectors, fuel injector systems, and methods may "comprise," "consists of," or "consist essentially of" any of the above-described components and/or features and/or steps of the nozzles, nozzle plates, fuel injectors, fuel injector systems, and methods. Consequently, where the present invention, or a portion thereof, has been described with an open-ended term such as "comprising," it should be readily understood that (unless otherwise stated) the description of the present invention, or the portion thereof, should also be interpreted to describe the present invention, or a portion thereof, using the terms "consisting essentially of" or "consisting of" or variations thereof as discussed below.

As used herein, the terms "comprises," "comprising," "includes," "including," "has," "having," "contains", "containing," "characterized by" or any other variation thereof, are intended to encompass a non-exclusive inclusion, subject to any limitation explicitly indicated otherwise, of the recited components. For example, a nozzle, nozzle plate, fuel injector, fuel injector system, and/or method that "comprises" a list of elements (e.g., components or features or steps) is not necessarily limited to only those elements (or components or features or steps), but may include other elements (or components or features or steps) not expressly listed or inherent to the nozzle, nozzle plate, fuel injector, fuel injector system, and/or method.

As used herein, the transitional phrases "consists of" and "consisting of" exclude any element, step, or component not specified. For example, "consists of" or "consisting of" used in a claim would limit the claim to the components, materials or steps specifically recited in the claim except for impurities ordinarily associated therewith (i.e., impurities within a given component). When the phrase "consists of" or "consisting of" appears in a clause of the body of a claim, rather than immediately following the preamble, the phrase "consists of" or "consisting of" limits only the elements (or components or steps) set forth in that clause; other elements (or components) are not excluded from the claim as a whole.

As used herein, the transitional phrases "consists essentially of" and "consisting essentially of" are used to define a nozzle, nozzle plate, fuel injector, fuel injector system, and/or method that includes materials, steps, features, components, or elements, in addition to those literally disclosed, provided that these additional materials, steps, features, components, or elements do not materially affect the basic and novel characteristic(s) of the claimed invention. The term "consisting essentially of" occupies a middle ground between "comprising" and "consisting of".

Further, it should be understood that the herein-described nozzles, nozzle plates, fuel injectors, fuel injector systems, and/or methods may comprise, consist essentially of, or consist of any of the herein-described components and features, as shown in the figures with or without any additional feature(s) not shown in the figures. In other words, in some embodiments, the nozzles, nozzle plates, fuel injectors, fuel injector systems, and/or methods of the present invention may have any additional feature that is not specifically shown in the figures. In some embodiments, the nozzles, nozzle plates, fuel injectors, fuel injector systems, and/or methods of the present invention do not have any additional features other than those (i.e., some or all) shown in the figures, and such additional features, not shown in the figures, are specifically excluded from the nozzles, nozzle plates, fuel injectors, fuel injector systems, and/or methods.

The present invention is further illustrated by the following examples, which are not to be construed in any way as imposing limitations upon the scope thereof. On the contrary, it is to be clearly understood that resort may be had to various other embodiments, modifications, and equivalents thereof which, after reading the description herein, may suggest themselves to those skilled in the art without departing from the spirit of the present invention and/or the scope of the appended claims.

EXAMPLE 1

Nozzles, similar to exemplary nozzles 10 as shown in FIGS. 1-2 and 4-9, were prepared for use in fuel injector systems, similar to exemplary fuel injector system 100.

From the above disclosure of the general principles of the present invention and the preceding detailed description, those skilled in this art will readily comprehend the various modifications, re-arrangements and substitutions to which the present invention is susceptible. Therefore, the scope of the invention should be limited only by the following claims and equivalents thereof. In addition, it is understood to be within the scope of the present invention that the disclosed and claimed nozzles may be useful in other applications (i.e., not as fuel injector nozzles). Therefore, the scope of the invention may be broadened to include the use of the claimed and disclosed structures for such other applications.

What is claimed is:

1. A fuel injector nozzle comprising:

an inlet face; an outlet face opposite said inlet face; and a plurality of nozzle through-holes, with each of said nozzle through-holes comprising at least one inlet opening on said inlet face connected to at least one outlet opening on said outlet face by a cavity defined by an interior surface, each said at least one inlet opening having an inlet opening dimension, D, each said at least one outlet opening having an outlet opening dimension, d, and at least one of said nozzle through-holes exhibiting a coefficient of discharge, Cd, of greater than about 0.50 as calculated by the formula:

$$C_D = \frac{Q_{Outlet}}{A_{Outlet}\sqrt{\frac{2*(P_1 - P_2)}{\rho\left[1 - \left[\frac{A_{Outlet}}{A_{Inlet}}\right]^2\right]}}},$$

wherein:

$Q_{outlet}$ represents a volumetric flow rate of a fluid exiting said at least one outlet opening;

$A_{outlet}$ represents an outlet area of said at least one outlet opening;

$A_{inlet}$ represents an inlet area of said at least one inlet opening;

$P_1$ represents a first pressure along said at least one inlet opening;

$P_2$ represents a second pressure along said at least one outlet opening; and

ρ represents a density of a fluid exiting said at least one outlet opening, wherein $A_{outlet}$ is smaller than $A_{inlet}$.

2. The fuel injector nozzle of claim 1, wherein said inlet face has a surface area comprising (i) a combined inlet opening area of said plurality of nozzle through-holes and (ii) an inlet land area, and said inlet land area defines from about 26% to about 74% of said inlet face surface area.

3. The fuel injector nozzle of claim 2, wherein each said at least one outlet opening has an outlet opening area, said outlet face has an outlet surface area comprising (i) a combined outlet opening area of said plurality of nozzle through-holes and (ii) an outlet land area, and said combined outlet opening area is less than about 6.80% of said combined inlet opening area.

4. The fuel injector nozzle of claim 3, wherein each nozzle through-hole has a coefficient of discharge, Cd, of at least about 0.90.

5. The fuel injector nozzle of claim 4, wherein at least one of the plurality of nozzle through-holes has a polygon shaped inlet opening with at least three side edges extending along said inlet face.

6. The fuel injector nozzle of claim 5, wherein there is no inlet land area between any two adjacent inlet openings.

7. The fuel injector nozzle of claim 6, wherein the inlet opening of each said plurality of nozzle through-holes has side edges in a hexagonal shape and the outlet opening of each said plurality of nozzle through-holes has a circular shape, and each of at least three of the side edges of each inlet opening defines a side edge for two of the inlet openings.

8. The fuel injector nozzle of claim 7, wherein portions of said inlet face and said outlet face are parallel with one another.

9. The fuel injector nozzle of claim 1, wherein said fuel injector nozzle is a nozzle plate having a flat configuration.

10. A fuel injector comprising the fuel injector nozzle according to claim 1.

11. A fuel injector system comprising the fuel injector of claim 10.

12. A method of using the fuel injector nozzle of claim 1, said method comprising:

incorporating the fuel injector nozzle into a fuel injector system of a vehicle so as to accomplish at least one of (a) reduce an overall energy requirement of the vehicle, (b) increase an overall fuel efficiency of the vehicle, and (c) maintain a mass flow rate of a fluid through the fuel injector system of the vehicle while utilizing a reduced pressure within the fuel injector system.

13. The fuel injector nozzle of claim 1, wherein each of the plurality of nozzle through-holes has a coefficient of discharge, Cd, of at least about 0.90.

14. The fuel injector nozzle of claim 1, wherein at least one of the plurality of nozzle through-holes has a polygon shaped inlet opening with at least three side edges extending along said inlet surface.

15. The fuel injector nozzle of claim 1, wherein there is no inlet land area between any two adjacent inlet openings.

16. The fuel injector nozzle of claim 1, wherein the inlet opening of each said plurality of nozzle through-holes has side edges in a hexagonal shape and the outlet opening of each said plurality of nozzle through-holes has a circular shape, and each of at least three of the side edges of each inlet opening defines a side edge for two of the inlet openings.

17. The fuel injector nozzle of claim 1, wherein portions of said inlet face and said outlet face are parallel with one another.

18. The fuel injector nozzle of claim 1, wherein each said outlet opening has an outlet opening area, said outlet face has an outlet surface area at least comprising the combined outlet opening of said nozzle through-holes and an outlet land area, and said combined outlet opening area is less than said combined inlet opening area.

19. The fuel injector nozzle of claim 18, wherein said inlet face has a surface area comprising (i) a combined inlet opening area of said plurality of nozzle through-holes and (ii) an inlet land area, and said inlet land area defines from about 26% to about 74% of said inlet face surface area.

20. The fuel injector nozzle of claim 19, wherein each of the plurality of nozzle through-holes has a curved surface profile directly extending along its interior surface from its at least one inlet opening to its at least one outlet opening.

21. The fuel injector nozzle of claim 18, wherein the maximum outlet opening diameter is about 200 μm.

* * * * *